US007838476B1

(12) United States Patent
Wagner

(10) Patent No.: US 7,838,476 B1
(45) Date of Patent: Nov. 23, 2010

(54) GENERATION OF RESIDUE-FREE DECONTAMINANT USING HYDROGEN PEROXIDE, AMMONIA, AND CARBON DIOXIDE

(75) Inventor: George W. Wagner, Elkton, MD (US)

(73) Assignee: The United States as represented by the Secretary of the Army, Washington, DC (US)

( * ) Notice: Subject to any disclaimer, the term of this patent is extended or adjusted under 35 U.S.C. 154(b) by 312 days.

(21) Appl. No.: 12/238,862

(22) Filed: Sep. 26, 2008

(51) Int. Cl.
*C11D 3/10* (2006.01)
*C11D 7/18* (2006.01)
*C11D 3/44* (2006.01)

(52) U.S. Cl. ..... 510/110; 510/405; 510/421; 510/432; 510/367; 510/372; 588/249.5; 588/299; 588/300; 588/400

(58) Field of Classification Search ..... 510/110, 510/405, 421, 432, 367, 372; 588/249.5, 588/299, 300, 400
See application file for complete search history.

(56) References Cited

U.S. PATENT DOCUMENTS 3,846,535 A * 11/1974 Fonseca ..... 423/243.06
4,329,320 A * 5/1982 Vydra et al. ..... 423/1
4,502,997 A * 3/1985 Tsao ..... 558/327
5,259,848 A * 11/1993 Terry et al. ..... 8/111
5,318,758 A * 6/1994 Fujii et al. ..... 423/228
6,566,574 B1 * 5/2003 Tadros et al. ..... 252/186.41
7,662,759 B1 * 2/2010 Tucker et al. ..... 510/110
2003/0060517 A1 * 3/2003 Tucker et al. ..... 516/38
2003/0158459 A1 * 8/2003 Tucker ..... 588/200
2005/0109981 A1 * 5/2005 Tucker et al. ..... 252/186.38
2009/0185993 A1 * 7/2009 Nocker et al. ..... 424/70.2

* cited by examiner

*Primary Examiner*—Charles I Boyer
(74) *Attorney, Agent, or Firm*—Ulysses John Biffoni

(57) ABSTRACT

A method for in situ generation of a decontamination solution adapted to decontaminate mustard agents by oxidation and nerve agents by perhydrolysis, comprising the steps of generating a stable precursor solution of aqueous $NH_4HCO_3$ by bubbling $CO_2$ and $NH_3$ into a container of water; and adding a peroxide component to the precursor solution. The step of bubbling $CO_2$ into a container of water may be accomplished by bubbling fossil fuel engine exhaust including $CO_2$ directly into the container of water.

17 Claims, No Drawings

GENERATION OF RESIDUE-FREE DECONTAMINANT USING HYDROGEN PEROXIDE, AMMONIA, AND CARBON DIOXIDE

GOVERNMENT INTEREST

The invention described herein may be manufactured, licensed, and used by or for the United States Government

FIELD OF THE INVENTION

This invention relates to methods for decontaminating chemical warfare agents. More specifically, the invention relates to methods for decontaminating mustard agents such as the vesicant HD by oxidation, as well as nerve agents such as VX and GD by perhydrolysis using environmentally safe, stable, clean reactants that leave no residue and that can be prepared on site, in the field of combat.

BACKGROUND OF THE INVENTION

Military forces are confronted with chemical agents in battlefields and both military and civilians are at risk for chemical leaks and terrorist attacks using chemical weapons. Decontamination systems are important because they allow rapid neutralization of hazardous materials in the immediate area of a soldier. To date, decontamination systems include liquid solutions, solid sorbents, and gaseous mixtures that allow the rapid decontamination and restoration of materials and equipment in order to minimize downtime for military operations.

Several types of toxic chemical compounds are known to be useful as chemical warfare agents. These include mustard agents or gases known as blister agents, such as bis-(2-chloroethyl)sulfide, also know as HD, and nerve agents such pinacolyl methylphosphonofluoridate, which is also known as GD, and O-ethyl S-(2-diisopropylamino)ethylmethylphosphonothioate, which is known a VX. HD is a colorless, oily liquid that is highly insoluble in water and it is a powerful vesicant (causes blistering of skin) which affects the eyes and the lungs, blisters the skin, and is considered a carcinogen. HD is also cytotoxic to hematopoietic tissue and can be lethal at high doses. GD and VX are powerful nerve agents that attack the nerve cells and impair the functioning of the central nervous system.

As discussed in U.S. Pat. Nos. 6,245,957 and 6,723,891, to decontaminate the vesicant mustard gas and render it non-vesicant, it is necessary to oxidize the mustard gas to the corresponding sulfoxide. Nerve agents such as VX and GD are rendered non-toxic by perhydrolysis to their non-toxic phosphonic acids. The oxidation of HD to HD-sulfoxide (HDO) renders the gas non-vesicant. The reaction of a nerve agent with peroxide compounds is effective as an oxidation process to decontaminate nerve agents. Mildly-basic peroxide is also known to cause the perhydrolysis of VX and GD to their non-toxic phosphonic acids. Peroxides are desirable reactants for decontamination because they are non-toxic and non-corrosive, as compared to hypochlorite-based processes, which are toxic and therefore environmentally damaging.

Current hydrogen peroxide based decontaminants such as DF200® produced by Envirofoam Technologies and Decon Green® produced by Steris Corp require non-liquid activators and/or surfactants which leave a white solid residue following decontamination operations. This white solid residue has to be removed by rinsing of the decontaminated items.

This is especially important for military vehicles so that they may maintain their low visibility and/or low IR signature.

Recently, a gaseous decontaminant, known as Modified Vaporized Hydrogen Peroxide (mVHP®) produced by Steris Corp., has shown that hydrogen peroxide ($H_2O_2$) vapor, when mixed with minor amounts of ammonia gas ($NH_3$), is efficacious for the decontamination of chemical warfare agents and biological warfare agents such as anthrax on surfaces. Being that mVHP® is a gas, it is best suited to operate as a decontaminating "fumigant" for enclosed areas, such as buildings, vehicles, and aircraft interiors. An advantage of the mVHP® gas, is that when used for decontaminating chemical warfare agents and biological warfare agents, it does not leave a residue and is benign to sensitive equipment and materials. The mVHP® process is described in U.S. Pat. No. 7,102,052.

Although gaseous, $NH_3$ is able to afford suitable activation of the $H_2O_2$ in the gas phase for the decontamination of chemical warfare agents VX and GD. However, gaseous $NH_3$ alone would not be effective as an activator for a solution of $H_2O_2$ based decontaminants because of its inability to generate the necessary peroxo species required for facile HD oxidation. Peroxo species are typically generated by the reaction of $H_2O_2$ with alkali molybdates or bicarbonates in solution, to form peroxomolybdate or peroxocarbonate species, which are much more effective oxidation catalysis for HD than $H_2O_2$ itself. Such alkali activators are extremely stable for transport and storage. Their main drawback is the need to rinse away the white residues remaining following their use in decontaminating of chemical warfare agents VX and GD.

An alternate bicarbonate activator, ammonium bicarbonate ($NH_4HCO_3$) in powder form, would not leave a lasting residue as it decomposes to $NH_3$, water, and carbon dioxide ($CO_2$); a process greatly accelerated by heat. Thus, although $NH_4HCO_3$ could be utilized with $H_2O_2$ to generate a no-rinse, residue-free decontaminant, this material would not be stable under the potentially-uncontrolled storage conditions that are common to the military, such as in the field of combat.

Similar to the reasons discussed above, U.S. Pat. Nos. 6,245,957; 6,566,574; 6,723,890; and 7,390,432, also relate to the present invention. However, one significant distinction is that certain of the constituents are not stable and difficult to use in the field of combat.

SUMMARY OF THE INVENTION

It is an object of the present invention to demonstrate the efficacy of decontaminants generated using $CO_2$, $NH_3$, $H_2O_2$, and water as active ingredients for the decontamination of the vesicant VX and nerve agents GD and HD.

It is a further object of the present invention to employ additional ingredients including surfactants (Triton X-100) which is a wetting agent that makes the decontamination solution more effective against toxins that repel water, co-solvents propylene carbonate which is a solvent for some agents which are oily in nature to aid in the dissolution of water-insoluble HD, and propylene glycol which stabilizes the liquid decontaminant below freezing temperatures to allow the use of the decontamination solution at sub-zero temperatures.

According to an embodiment of the present invention, since commercial $CO_2$ is typically generated or recovered from the combustion of fossil fuels, a ready source for $CO_2$ during decontamination operations in the field of combat could be recovered from vehicle exhaust (burning fossil fuel such as diesel, gasoline, coal natural gas).

According to an embodiment of the present invention, $CO_2$ exhaust gases recovered from a diesel-powered, decontamination solution applicator, such as the Falcon™ fixed-site decontamination system, can be mixed with $NH_3$ in an aqueous solution to generate $NH_4HCO_3$. The resulting $NH_4HCO_3$ could then be used as the requisite activator to generate an efficacious $H_2O_2$-based decontaminant solution. Note that the Falcon is a large-scale compressed air foam truck and trailer system capable of dispersing fire-suppression foam as well as biological and chemical warfare decontamination formulas.

According to an embodiment of the invention, the exhaust fixed-site decontamination system can both generate $CO_2$ to create and to spray a bicarbonate-activated, $H_2O_2$-based decontaminant solution. Such a solution could be composed from, at a minimum of four stable, multipurpose decontamination precursor materials, $NH_3$, $CO_2$, $H_2O_2$ and water. Further, after activation of $NH_3$ by $CO_2$ to generate $NH_4HCO_3$ and then the use of the latter for decontamination, the $NH_4HCO_3$ decomposes to the residue-free, no-rinse solution of $NH_3$, $CO_2$ and water.

According to the present invention, there is disclosed a method for generating a decontamination solution adapted to decontaminate mustard agents by oxidation and nerve agents by perhydrolysis in situ, comprising the steps of: generating a stable precursor solution of aqueous $NH_4HCO_3$ in situ by bubbling $CO_2$ and $NH_3$ into a container of water; and adding a peroxide component to the precursor solution. The method also includes the step of mixing an alcohol component to the precursor solution.

Also according to the present invention, the step of bubbling $CO_2$ into a container of water includes the step of bubbling fossil fuel engine exhaust including $CO_2$ into the container of water. Further, the step of bubbling $CO_2$ and $NH_3$ includes the step of stirring the water in the container as the $CO_2$ and $NH_3$ are bubbled therethrough.

Further according to the present invention, the alcohol component includes: polyoxyethylene ethers as a surfucant for the decontamination solution; propylene glycol as a non-toxic anti-freeze for the decontamination solution; and propylene carbonate to act as a solvent for some of the agents.

Still further according to the present invention, the decontaminant solutions are for decontaminating mustard agents such as the vesicant HD by oxidation; and nerve agents such as VX and GD by perhydrolysis. In addition, the perhydrolysis leaves no residue and can be prepared in situ.

Yet further according to the present invention, the step of generating the decontamination solution includes: providing the precursor solution of aqueous $NH_4HCO_3$ to be about 1% by volume to about 50% by volume of the decontamination solution; mixing between about 0.1% by volume to about 15% by volume of polyoxyethylene ether into the precursor solution; mixing between about 0.1% by volume to about 15% by volume of propylene carbonate into the precursor solution; mixing between about 1% by volume to about 50% by volume of propylene glycol into the precursor solution; and mixing between about 1% by volume to about 50% by volume of an aqueous solution of the peroxide component $H_2O_2$ into the precursor solution.

Still further according to the present invention, the step of generating the decontamination solution includes providing the precursor solution of aqueous $NH_4HCO_3$ to be about 25% by volume of the decontamination solution; mixing about 10% by volume of polyoxyethylene ether into the precursor solution; mixing about 10% by volume of propylene carbonate into the precursor solution; mixing about 25% by volume of propylene glycol into the precursor solution; and mixing about 25% by volume of an aqueous solution of the peroxide component $H_2O_2$ into the precursor solution.

Also according to the present invention, the decontamination solution is generated by mixing $NH_3$, $H_2O_2$, and water, and then bubbling fossil fuel engine exhaust that contains $CO_2$ through the solution so that the $NH_3$, $CO_2$, and water are activated in situ to form $NH_4HCO_3$.

Further according to the present invention, the precursors of the liquid decontamination solution can also be used to produce a gaseous decontaminate, allowing a single set of precursors to uniquely produce both gaseous and solution decontaminants thereby reducing inventory complexity and increasing application flexibility.

Yet further according to the present invention, the decontamination solution leaves no-residue on treated materials that require removal by a liquid rinsing operation.

Also according to the present invention, the decontamination solution's final reactants are environmentally safe and non-toxic.

Further according to the present invention, the decontamination efficiency is between 1 and 30 minutes when the volume ratio of decontaminant solution to chemical warfare agent, VX, GD, or HD, is 50 to 1 and the concentration of the active ingredient in the decontaminate solution, $NH_4HCO_3$, is at 1.6 M (moles/L).

Yet further according to the present invention, the surfactant, Triton X-100 and co-solvents Propylene Carbonate and Propylene Glycol are added to the solution of active ingredients to prevent the solution from freezing or slushing at temperatures greater than −20 degrees Celsius and the co-solvents aid in the dissolution of the water-insoluble HD agent.

Also according to the present invention, the resulting $NH_4HCO_3$ decontamination solution does not slush, freeze, or precipitate at temperatures from about −10 degree C. to about −35 degree C.

Still further according to the present invention, the $NH_4HCO_3$ decontamination solution is preferably maintained at a pH of from about 7 to about 12.

Yet further according to the present invention, the $NH_4HCO_3$ decontamination solution decomposes to $NH_3$ and $CO_2$ gases and liquid $H_2O$.

Also according to the present invention, the $NH_4HCO_3$ decontamination solution effectively decontaminates mustard agents by oxidation and nerve agents by perhydrolysis with 1 part agent to 50 parts of decontaminant.

According to the present invention, the $NH_4HCO_3$ decontamination solution effectively decontaminates mustard agents by oxidation and nerve agents by perhydrolysis with 1 part agent to 50 parts of decontaminant in less than about 30 minutes.

DETAILED DESCRIPTION OF THE PREFERRED EMBODIMENT

An embodiment of the present invention is a nerve and mustard agent, especially VX, GB, GD, and HD chemical agents, decontamination composition and method for neutralizing chemical warfare agents with the composition. The composition includes a mixture of ammonium bicarbonate, peroxide and alcohol components. As a suitable replacement for decontaminants that leave a residue, the present invention has a broad-spectrum reactivity towards all agents, even in cold weather operations, while achieving a significant reduction in the toxic, corrosive and environmentally harmful nature of the decontaminant.

An embodiment of the present invention may be used for a broad range of chemical warfare agents and/or decontamination applications, ranging from heavy equipment to sensitive equipment/electronics, building, aircraft and vehicle interiors, and personnel.

An embodiment of the present invention is a chemical warfare agent decontaminating composition comprising a mixture of ammonium bicarbonate, peroxide and alcohol components effective to degrade and detoxify a chemical warfare agent. The term "composition" may include, without limitation, sprays, vapors, liquids, solids, and/or other physical forms of mixtures that incorporate the ammonium bicarbonate, peroxide and alcohol components as a unitary decontaminant. Preferably, the mixture comprises a blended liquefied combination of the components. A blended liquefied combination of the components provides the mixed compounds as uniformly dispersed together within the mixture.

An embodiment of the present invention relates to methods for forming decontaminant solutions adapted for decontaminating mustard agents such as the vesicant HD by oxidation, as well as nerve agents such as VX and GD by perhydrolysis. An important aspect of an embodiment of the present invention is that perhydrolysis uses environmentally safe, stable, clean reactants that leave no residue and that can be prepared in situ, i.e., in the field of combat.

The method of generating the decontaminating solutions first includes the step of generating a $NH_4HCO_3$ (ammonium bicarbonate) solution by bubbling $NH_3$ at between about 1000 liters per minute (L/min) and 0.1 milliliters per minute (mL/min), depending on scale-of-use, into a suitable container such as a mixing tank or bottle containing about 1000 L to about 1 mL. For testing purposes, $NH_3$ can be bubbled at about 120 mL/min into a container such as a bottle containing about 200 mL of water. It's desirable that the water be stirred as the gases are bubbled there through. In addition, and preferably at the same time as the $NH_3$ is being bubbled through the stirred water, between about 1000 L/min and about 0.1 mL/min $CO_2$ is bubbled into the bottle of stirred water. For testing an embodiment of the present invention, approximately about 200 mL/min $CO_2$ is bubbled into the bottle of stirred water. However, it is preferable in practice that the same amount of $NH_3$ and $CO_2$ are bubbled into the water.

An important aspect of an embodiment of the present invention relates to the source of $CO_2$ during decontamination operations in the field of combat. $CO_2$ is generally cumbersome to provide on a military battleground.

According to an embodiment of the present invention, suitable $CO_2$, is typically generated or recovered from the combustion of fossil fuels. A ready source for $CO_2$ during decontamination operations in the field of combat is that recovered from a vehicle exhaust (burning fossil fuel such as diesel, gasoline, coal natural gas). The exhaust is simply delivered by a pipe, such a flexible hose, to a container of water used to mix the $NH_3$ and $CO_2$.

For example, $CO_2$ exhaust gases recovered from a diesel-powered, decontamination solution applicator, such as the Falcon™ fixed-site decontamination system, can be mixed with $NH_3$ in an aqueous solution to generate $NH_4HCO_3$.

Practicing the previously described method in a testing situation within a laboratory resulted in a build-up of dissolved $NH_4HCO_3$ in the solution. The buildup was monitored by a nuclear magnetic resonance spectrometer (NMR) as shown in Table 1.

TABLE 1

Formation of $NH_4HCO_3$ in Water Solution

| Time Minutes | $NH_4HCO_3$ M |
|---|---|
| 15 | 0.27 |
| 30 | 0.53 |
| 45 | 0.80 |
| 60 | 1.00 |
| 75 | 1.30 |
| 90 | 1.60 |

Table 1 illustrates the results of a test of bubbling both $NH_3$ and $CO_2$, at a rate of about 120 mL/min $NH_3$ and 200 mL/min $CO_2$, into a bottle containing about 200 mL of stirred water. It's desirable that the water be stirred as the gases are bubbled through the bottle.

After about 90 minutes, the $NH_3$ and $CO_2$ bubbling is halted and the resulting solution contains about 1.60 moles per liter (M) of $NH_4HCO_3$. It's understood that the resulting amount of $NH_4HCO_3$ could be generated faster with a higher flow rate of $NH_3$ and $CO_2$ and/or optimized mixing devices.

The next step entails generating a typical decontamination solution by mixing several additional constituents into the solution of $NH_4HCO_3$. First, Triton X-100 (a surfactant wetting agent that makes the decontamination solution more effective against agents and toxins that repel water) can be mixed in at between about 0.1% by volume to about 15% by volume and preferably about 10% by volume. Next, propylene carbonate (a solvent for some agents such as HD which are oily in nature) can be mixed in at between about 0.1% by volume to about 15% by volume and preferably about 10% by volume to aid in the dissolution of water-insoluble HD. Continuing, propylene glycol (antifreeze) can be mixed in at between about 1% by volume to about 50% by volume and preferably at 25% by volume. The propylene glycol stabilizes the liquid decontaminant below freezing temperature's to allow the use of the decontamination solution at sub-zero temperatures. Next, the aqueous solution of $H_2O_2$, typically of a concentration of about 35% $H_2O_2$, can be mixed in at between about 1% by volume to about 50% by volume and preferably about 30% by volume, with the remainder of the solution being the $NH_4HCO_3$ solution generated as previously discussed. The $NH_4HCO_3$ solution being the remainder can be between about 0.1M to 5M and preferably 1.6M of $NH_4HCO_3$. The $NH_4HCO_3$ solution can make up between about 1% to about 50% by volume and preferably about 25% by volume of the resulting $NH_4HCO_3$ and $H_2O_2$ decontamination solution.

The propylene glycol and propylene carbonate solvent components of the mixture provide antifreeze and a co-solvent to the solution, respectively. The solvents also aids in dissolving the chemical warfare agent. The solvent components, however, may comprise any compound suitable as a co-solvent with lower molecular weight alcohols, such as less than about 300 MW, being particularly desirable. Co-solvents may include, without limitation, t-BuOH, ethanol (grain alcohol), isopropanol (rubbing alcohol), propylene glycol (a food additive and non-toxic anti-freeze), polypropylene glycol (a food additive) and/or derivatives and combinations thereof. The compounds propylene glycol and propylene carbonate are particularly effective and preferred.

The surfactant wetting agent, a solvent for some agents which are oily in nature, and the co-solvent component generally fit into a group of chemical mixtures known as microemulsions. In general, a microemulsion is a transparent or translucent, thermodynamically stable, isotropic dispersion of two immiscible liquids with microdomains of one or both liquids stabilized by an interfacial film of surface-active molecules. It typically comprises water, at least one organic solvent (oil), at least one surfactant, and in most cases at least one co-solvent. The water-in-oil microemulsions are roughly spherical water microdroplets coated by an interfacial film of a surfactant, e.g. sodium dodecyl sulfate (SDS), and a co-solvent, e.g. butanol (BuOH), and dispersed in a continuous phase of oil, e.g. hexane. The suitable surfactants non-exclusively include cetyltrimethylammonium chloride (CTAC), and polyoxyethylene ethers, such as polyoxyethylene isooctylphenyl ether (Triton X-100). Of these, polyoxyethylene ethers are preferred. Other suitable co-solvents non-exclusively include 2-propanol, 2-methyl-1-propanol and propylene carbonate. Of these, propylene carbonate is preferred. The microemulsion may also further include at least one carbonate and/or bicarbonate activator as described above. The bicarbonate component (e.g. $NH_4HCO_3$) and the peroxide component (e.g. $H_2O_2$) are dissolved within the microemulsion to form the desired monoperoxocarbonate compound. The hydrogen peroxide is generally added in batches to the medium. It generates $O_2$, but also some water as a side product derived both from the disproportionation and from the water of dilution of hydrogen peroxide.

The microemulsion should ideally be designed to meet three requirements: no phase separation during storage and during the oxidation reaction; high solubility of the reactants (e.g. peroxide and bicarbonate components); and simple recovery of the oxidized product, surfactant, and catalyst (bicarbonate compound) at the end of the reaction. Furthermore, none of the components of the microemulsion itself should react with the peroxide, bicarbonate or the intermediates derived therefrom (monoperoxocarbonate). In an alternate embodiment, the monoperoxocarbonate compound may be dispersed in a water-surfactant medium. The water-surfactant medium may include any of the surfactants described above, and may further include one or more co-solvents from the list described above.

The process includes forming a monoperoxocarbonate compound having the formula $HCO_4^-$, in a suitable medium by reacting a peroxide component and a bicarbonate component in the medium. The preferred medium is a microemulsion which was described above. The peroxide component comprises a material selected from the group consisting of hydrogen peroxide, solid urea hydrogen peroxide, sodium percarbonate peroxide, polymer-supported (e.g. polyvinylpyrrolidinone) hydrogen peroxides, and combinations and derivatives thereof. Of these, the preferred peroxide is 35% aqueous $H_2O_2$. Solid hydrogen peroxide forms such as sodium percarbonate and polymer-supported (e.g. polyvinylpyrrolidinone) hydrogen peroxides is also particularly applicable to address concerns of storage and handling of concentrated aqueous hydrogen peroxide in the field. Additionally, these solid peroxide forms are non-toxic and environmentally friendly. The peroxide component is preferably present in the microemulsion at from about 1 to about 25 weight percent, more preferably from about 5 to about 20 weight percent, and most preferably from about 8 to about 15 weight percent.

The resulting $NH_4HCO_3$ decontamination solution exhibits stability and does not slush, freeze, or precipitate at temperatures from about −10 degrees C. to about −35 degrees C., more preferably from about −25 degrees C. to about −30 degrees C., and most preferably from about −30 degrees C. to about −35 degrees C. Additionally, the $NH_4HCO_3$ decontamination solution is preferably maintained at a pH of from about 7 to about 12, more preferably from about 7.5 to about 11, and most preferably from about 8 to about 10.

Because of this temperature range, the resulting decontamination solution is suitable for use at ambient and sub-zero temperatures. An important quality of this decontamination solution is that it will not leave any persistent residue after evaporation of the liquid constituents or the decomposition of $NH_4HCO_3$ to the gases $NH_3$ and $CO_2$, and liquid $H_2O$. In some cases, there is initially a white powder that will typically evaporate within about several minutes to hours, depending on the thickness of the deposit and climatic conditions such as temperature, wind, and sunlight.

For effective decontamination of mustard agents such as HD by oxidation, as well as nerve agents such as VX and GD by perhydrolysis, it is desirable to decontaminate 1 to 50 challenges, that is decontaminating 1 part agent with 50 parts of decontaminant. For example, about 50 mL of decontaminant should be able to decontaminate 1 mL of chemical warfare agent. Further, the decontamination time should preferably require 30 minutes or less. Table 2 shows the results of a laboratory test where the reaction rates of 1:50 challenges of VX, GD and HD with the no-residue decontamination solution described above.

When used on a chemical warfare agent, such as for example HD, VX, and GD, the above described solution is placed in contact with the chemical warfare agent. The contact may be accomplished by immersing a chemical warfare agent covered article in the solution, spraying the solution onto an article, or other contacting means that permit the chemical warfare agent to react with the composition of the present invention, preferably by dissolving the chemical warfare agent into a solution of the composition. Contact may also be accomplished by any combining of the chemical warfare agent with the composition that permits a reaction. After contact, the combined composition and chemical warfare agent may be agitated, stirred or rubbed to mix them together. Once contacted, the composition reacts and neutralizes the chemical warfare agent. Neutralization of the chemical warfare agent occurs with chemical degradation that decreases the effectiveness of the chemical warfare agent as a hazard to personnel. An important aspect of an embodiment of the present invention is that neutralization is accomplished quickly and without leaving a persistent residue.

An exemplary no-residue decontamination solution includes about 10% by volume of Triton X-100, about 10% by volume of propylene carbonate, about 25% by volume of propylene glycol, 30% by volume of $H_2O_2$ (35% aqueous preferred) and the remainder of the solution being about 25% by volume of 1.6M of $NH_4HCO_3$. The results of a test using this decontamination solution with 1:50 challenges of VX, GD and HD are illustrated in Table 2.

TABLE 2

Reaction time and percent agent reacted for 50:1 challenges of VX, GD and HD with the No-Residue forming Decontamination Solution

| VX | | GD | | HD | |
|---|---|---|---|---|---|
| Minutes | % Remaining | Minutes | % Remaining | Minutes | % Remaining |
| 2 | 28.6 | 2 | 0 | 2 | 72.3 |
| 3 | 20.0 | | | 4 | 57.3 |
| 4 | 15.1 | | | 6 | 43.7 |
| 5 | 11.7 | | | 6 | 32.0 |
| 6 | 10.6 | | | 10 | 23.3 |
| 7 | 8.6 | | | 12 | 16.0 |
| 8 | 7.2 | | | 14 | 10.7 |
| 9 | 6.3 | | | 16 | 7.3 |

TABLE 2-continued

Reaction time and percent agent reacted for 50:1 challenges of VX, GD and HD with the No-Residue forming Decontamination Solution

| VX | | GD | | HD | |
|---|---|---|---|---|---|
| Minutes | % Remaining | Minutes | % Remaining | Minutes | % Remaining |
| 15 | 2.8 | | | 18 | 4.4 |
| 30 | 1.4 | | | 20 | 2.4 |
| 60 | 0.63 | | | 22 | 1.5 |
| 120 | 0 | | | 24 | <1.0 |
| No Toxic EA-2192 | | Peroxy-PMPA Observed | | Half-Life 3.6 minutes | |

Referring again to Table 2, it can be observed that when VX reacted with the exemplary no-residue decontamination solution described above, non-toxic ethyl methyl phosphoric acid, EMPA, was the sole product and no toxic EA-2192 compound was formed. The initial reaction was quite rapid, consuming 71.4% of the VX within the first two minutes. After 15 minutes, only 2.8% of the VX remained. The final non-significant proportion reacted completely within 2 hours.

Referring again to Table 2, it can be observed that the GD reaction with the exemplary no-residue decontamination solution described above is rapid and is complete within 2 minutes. Only non-toxic pinacolyl methylphosphonate, PMPA and Peroxy-PMPA were observed after the reaction completed. The presence of the Peroxy-PMPA intermediate signifies that the reaction included an attack peroxyanion nucleophile (OOH—), which is the expected mechanism for basic $H_2O_2$ decontaminants.

Referring again to Table 2, it can be observed that the HD reaction with the exemplary no-residue decontamination solution described above was pseudo-first order, exhibiting a half-life of 3.6 minutes. This half-life is considerably less than the 42 minute half-life previously reported by Wagner and Yang (U.S. Pat. No. 6,245,957) for HD in the absence of bicarbonate, and this half-life period is consistent with the formation of the powerful monoperoxocarbonate, $HCO_4^-$.

Although the invention has been shown and described with respect to a certain preferred embodiment or embodiments, certain equivalent alterations and modifications will occur to others skilled in the art upon the reading and understanding of this specification. In particular regard to the various methods and apparatus used in detecting multiple biological threat agents, the terms (including a reference to a "means") used to describe such detection are intended to correspond, unless otherwise indicated, to any methods or apparatus which perform the specified detection of the described multiple chemical and biological threat agents (i.e., that is functionally equivalent), even though not equivalent to the disclosed methods or apparatus which performs the function in the herein illustrated exemplary embodiments of the invention. In addition, while a particular feature of the invention may have been disclosed with respect to only one of several embodiments, such a feature may be combined with one or more features of the other embodiments as may be desired and advantageous for any given or particular application.

What is claimed is:

1. A method for generating a decontamination solution in situ, said solution adapted to decontaminate mustard agents by oxidation and nerve agents by perhydrolysis, comprising the steps of:

generating a stable precursor solution comprising aqueous $NH_4HCO_3$ in situ by bubbling $CO_2$ and $NH_3$ into a container of water, wherein said precursor solution of aqueous $NH_4HCO_3$ comprises about 1% by volume to about 50% by volume of the decontamination solution;

mixing between about 0.1% by volume to about 15% by volume of polyoxyethylene ether into the precursor solution;

mixing between about 0.1% by volume to about 15% by volume of propylene carbonate into the precursor solution;

mixing between about 1% by volume to about 50% by volume of propylene glycol into the precursor solution; and mixing between about 1% by volume to about 50% by volume of an aqueous solution of a peroxide component $H_2O_2$ into the precursor solution.

2. The method of claim 1, wherein the step of bubbling $CO_2$ into the container of water comprises bubbling fossil fuel engine exhaust including $CO_2$ into the container of water.

3. The method of claim 1, wherein the step of bubbling $CO_2$ and $NH_3$ into the container of water further includes the step of:

stirring the water in the container of water as the $CO_2$ and $NH_3$ are bubbled there through.

4. The method of claim 1, further including the step of:

mixing one or more additional components into the precursor solutions wherein said additional components are selected from the group consisting of alcohols having a molecular weight less than about 300 MW, cetyltrimethylalnmonium chloride (CTAC), and sodium dodecyl sulfate (SDS).

5. The method of claim 1, wherein the polyoxyethylene ether comprises a polyoxyethylene isooctylphenyl ether (Triton X-100) as a surfactant for the decontamination solution.

6. The method of claim 1, wherein the decontamination solution is used for decontaminating mustard agents such as the vesicant HD by oxidation, and nerve agents such as VX and GD by perhydrolysis.

7. The method of claim 6, wherein the perhydrolysis leaves no residue and can be conducted in situ.

8. The method of claim 1, wherein said precursor solution of aqueous $NH_4HCO_3$ comprises about 25% by volume of the decontamination solution;

wherein said polyoxyethylene ether comprises about 10% by volume of the decontamination solution;

wherein said propylene carbonate comprises about 10% by volume of the decontamination solution;

wherein said propylene glycol comprises about 25% by volume of the decontamination solution; and wherein said aqueous solution of the peroxide component $H_2O_2$ comprises about 25% by volume of the decontamination solution.

9. The method of claim 1, wherein the $CO_2$, $NH_3$, water and peroxide can also be used to produce a gaseous decontaminant comprising modified vaporous hydrogen peroxide (mVHP®), thereby allowing a single set of precursors to uniquely produce both gaseous and liquid decontaminants thereby reducing inventory complexity and increasing application flexibility.

10. The method of claim 1, wherein the decontamination solution leaves no residue on treated materials so that removal by a liquid rinsing operation is not required.

11. A method of claim 1, wherein the decontamination solution's final reactants are environmentally safe and non-toxic.

12. A method of claim 1, wherein the decontamination efficiency of the decontamination solution is between 0 and 30 minutes when the volume ratio of decontamination solution to chemical warfare agent, VX, GD, or HD, is 50 to 1 and the concentration of the active ingredient in the decontaminate solution, $NH_4HCO_3$, is about 1.6 moles per liter (M).

13. The method of claim 1, wherein the resulting $NH_4HCO_3$ and peroxide-based decontamination solution does not slush, freeze, or precipitate at temperatures from about −10 degrees C. to about −35 degrees C.

14. The method of claim 1, wherein the $NH_4HCO_3$ and peroxide-based decontamination solution is preferably maintained at a pH of from about 7 to about 12.

15. The method of claim 1, wherein the $NH_4HCO_3$ and peroxide-based decontamination solution decomposes to $NH_3$ and $CO_2$ gases and liquid $H_2O$.

16. The method of claim 1, wherein the $NH_4HCO_3$ and peroxide-based decontamination solution effectively decontaminates mustard agents by oxidation and nerve agents by perhydrolysis with 1 part agent to 50 parts of decontaminant.

17. The method of claim 16, wherein the $NH_4HCO_3$ and peroxide-based decontamination solution effectively decontaminates mustard agents by oxidation and nerve agents by perhydrolysis with 1 part agent to 50 parts of decontaminant in less than about 30 minutes.

* * * * *